United States Patent [19]

Numata

[11] 4,241,279

[45] Dec. 23, 1980

[54] CONTROL CIRCUIT FOR AN AUTOMATIC ELECTRONIC FLASH LIGHT DEVICE

[75] Inventor: Saburo Numata, Urawa, Japan

[73] Assignee: Fuji Photo Optical Co., Ltd., Omiya, Japan

[21] Appl. No.: 10,691

[22] Filed: Feb. 9, 1979

[51] Int. Cl.[3] ..... H05B 41/32

[52] U.S. Cl. ..... 315/151; 250/214 L; 354/33; 356/223

[58] Field of Search ..... 315/151, 159, 241 P; 354/24, 33, 145; 250/214 P, 214 L; 356/223

[56] References Cited

U.S. PATENT DOCUMENTS 3,779,142 12/1973 Ya ta et al. ..... 354/24
4,139,289 2/1979 Yamada et al. ..... 354/24
4,158,492 6/1979 Kitaura et al. ..... 354/24

FOREIGN PATENT DOCUMENTS 47-45018 11/1972 Japan ..... 356/223

*Primary Examiner*—Eugene R. LaRoche

[57] ABSTRACT

In an automatic electronic flash light device, a light measuring circuit includes an operational amplifier, a photosensor connected between the positive and negative inputs of the operational amplifier and a diode for log-compression connected in a feedback circuit of the operational amplifier. The output of the light measuring circuit is thus log-compressed and the log-compressed output is applied to an operational circuit which gives an output for controlling exposure.

1 Claim, 1 Drawing Figure

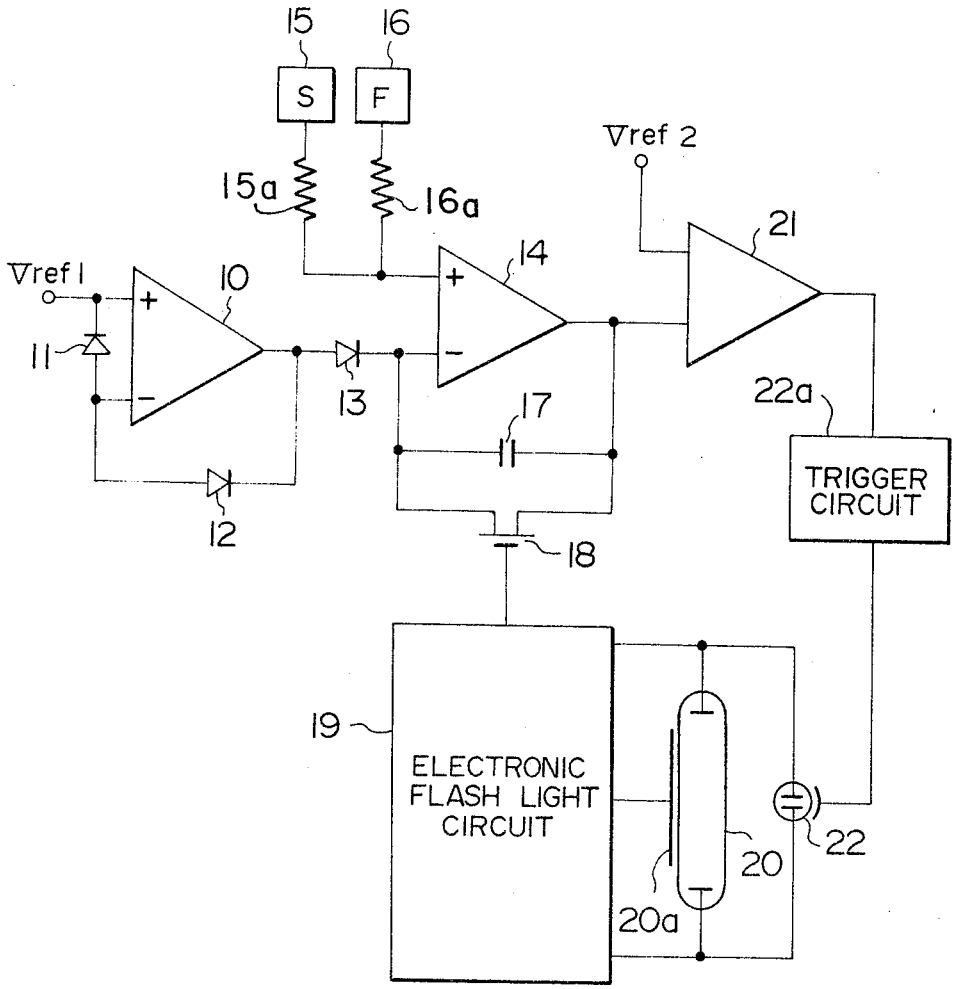
15
16
S
F
15a
16a
Vref 2
21
14
Vref 1
10
11
13
17
22a
TRIGGER CIRCUIT
12
18
19
ELECTRONIC FLASH LIGHT CIRCUIT
20
22
20a

CONTROL CIRCUIT FOR AN AUTOMATIC ELECTRONIC FLASH LIGHT DEVICE

BACKGROUND OF THE INVENTION

1. Field of the Invention

This invention relates to an improvement of an automatic electronic flash light device for a camera, and more particularly to a control circuit for an automatic electronic flash light device.

2. Description of the Prior Art

There has been known an automatic electronic flash light device for a camera in which an electric discharge of a flash light tube is terminated when the amount of light received by a photosensor in the camera from an object to be photographed illuminated by the light emitted by the flash light tube reaches a predetermined value.

In a conventional automatic electronic flash light device, the light from the object is converted into a photo current and the photo current is directly integrated by a capacitor so that the electric discharge of the flash light tube is terminated when the resulting integrated value reaches a predetermined value. The range of measurement in such a conventional automatic electronic flash light device is relatively narrow covering the brightness ranging over only two orders, i.e. $10^2$. Accordingly, the film speed and the size of the aperture of the diaphragm are limited in a narrow range with the amount of light calculated from the film speed and the size of the aperture falling within the narrow range of $10^2$ to obtain a proper exposure.

SUMMARY OF THE INVENTION

The primary object of the present invention therefore is to provide an improved control circuit for an automatic electronic flash light device capable of widening the range of measurement of the reflected light to about $10^6$, thereby permitting use of the film speed and the size of the aperture over wide ranges.

The above object can be accomplished by log-converting the photo current representing the scene brightness illuminated by the flash light and then inputing it into an operational circuit.

BRIEF DESCRIPTION OF THE DRAWING

The single FIGURE of the accompanying drawing is a circuit diagram of a control circuit for an automatic electronic flash light device in accordance with an embodiment of the present invention.

DESCRIPTION OF THE PREFERRED EMBODIMENT

In the single figure, a photosensor 11 is connected between the positive and negative inputs of an operational amplifier 10. The photosensor 11 which receives the light reflected by an object to be photographed is preferably of a high response type such as a silicon photodiode.

A reference voltage Vref 1 is applied to the positive input of the operational amplifier 10. A log-diode 12 for logarithmic compression is provided in a feedback circuit connecting the negative input of the operational amplifier 10 and the output thereof.

The output of the operational amplifier 10 is connected to the negative input of an operational amplifier 14 through a log-diode 13 for logarithmic expansion. An output from a film speed setting circuit 15 is inputed to the positive input of the operational amplifier 14 together with an output from an aperture size setting circuit 16.

The film speed information and the aperture value information are respectively represented by output voltages which are applied to the positive input of the operational amplifier 14 through resistors 15*a* and 16*a*. The film speed representing voltage and the aperture size representing voltage are stepwisely changed by, for example, about 20mV to represent such values respectively.

An electric current based on a difference in voltage between the voltage applied to the anode of the diode 13 by the output of the light measuring circuit or the operational amplifier 10 and a voltage applied to the cathode of the diode 13 by the input of the operational amplifier 14 based on the voltage determined by the film speed setting circuit 15 and the aperture size setting circuit 16 flows into the feedback circuit of the operational amplifier 14.

A capacitor 17 for integration is inserted in the feedback circuit of the operational amplifier 14. In parallel with the capacitor 17 is connected a switching element such as a field-effect transistor (FET) 18. The gate of the FET 18 is connected to an electronic flash light circuit 19, and the FET 18 is turned off when a flash light tube 20 connected with the flash light circuit 19 starts to discharge. When the FET 18 is turned off, the capacitor 17 starts to be charged.

The voltage level of the charged capacitor 17 is compared with the reference voltage Vref 2 by means of a comparator 21. The comparator 21 is inverted when the voltage level of the capacitor 17 reaches the reference voltage Vref 2. When the comparator 21 is inverted, the output level thereof becomes "high" and turns on a quenching tube 22 through a trigger circuit 22*a* to terminate the electric discharge of the flash light tube 20.

Said electronic flash light circuit 19 comprises a power source, a booster, a trigger circuit and a main capacitor as is well known in the art. When the trigger circuit is actuated, a high voltage is applied to a trigger electrode 20*a* to commence the electric discharge of the flash light tube 20.

When the shutter release button of a camera (not shown) is depressed and the shutter is opened, a high voltage is applied to the trigger electrode 20*a* to commence the electric discharge of the flash light tube 20, and simultaneously therewith the FET 18 is turned off.

The light emitted from the flash light tube 20 is relected by an object to be photographed and a part of the reflected light is received by the photosensor 11. The photosensor 11 outputs a photo current in accordance with the amount of the received light. The photo current is log-compressed by the log-compression log-diode 12 and a voltage output resulting from the log-compression is provided by the operational amplifier 10.

The log-compressed output of the amplifier 10 is applied to the negative input of the operational amplifier 14 through the log-diode 13. The film speed representing voltage from the film speed setting circuit 15 and the aperture size representing voltage from the aperture size setting circuit 16 are applied to the positive input of the operational amplifier 14.

The electric current resulting from the calculation in the operational amplifier 14 flows into the feedback circuit thereof and charges the integrating capacitor 17. When the integrating capacitor 17 is charged up to the reference voltage Vref 2, the comparator 21 is inverted and the quenching tube 22 is turned off, whereby the electric discharge of the flash light tube 20 is terminated.

I claim:

1. A control circuit for an automatic electronic flashlight device for a photographic camera in which an electric discharge of a flashlight tube is terminated when the amount of light received by a photosensor in the camera from an object to be photographed and illuminated by the light emitted by the flashlight tube reaches a predetermined level, said control circuit comprising; a light measuring circuit for measuring the amount of light received by said photosensor, said light measuring circuit including a first operational amplifier having an output and a first feedback circuit, a first diode in said first feedback circuit for long-compressing the output of said light measuring circuit, an operational circuit having a log-expanding circuit including a second diode and an operational amplifier with one input operatively connected to the output of said operational amplifier log-compressed by said first diode in said feedback circuit, film speed information input means having an output connected to the other input of said second operational amplifier, aperture size information means having an output also connected to said other input of said second operational amplifier, said second operational amplifier having a second feedback circuit, a capacitor provided in said second feedback circuit, a switching element in parallel with said capacitor and operatively connected to said flashlight device, and a comparing circuit for comparing the output of said second operational amplifier and second feedback circuit with a reference voltage and for giving an output for terminating the electric discharge of said flashlight tube when the level of the last-mentioned output equals that of said reference voltage.

* * * * *